US006450442B1

(12) United States Patent
Schneider et al.

(10) Patent No.: US 6,450,442 B1
(45) Date of Patent: Sep. 17, 2002

(54) IMPULSE RADAR GUIDANCE APPARATUS AND METHOD FOR USE WITH GUIDED PROJECTILES

(75) Inventors: Arthur J. Schneider; James G. Small, both of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 08/940,173

(22) Filed: Sep. 30, 1997

(51) Int. Cl.[7] ..... F41G 7/00
(52) U.S. Cl. ..... 244/3.14
(58) Field of Search ..... 244/3.19, 3.16, 244/3.15, 3.14, 3.13, 3.11

(56) References Cited

U.S. PATENT DOCUMENTS

| | | | | | |
|---|---|---|---|---|---|
| 4,097,007 | A | * | 6/1978 | Fagan et al. | 244/3.14 |
| 4,347,996 | A | * | 9/1982 | Grosso | 244/3.16 |
| 4,408,735 | A | * | 10/1983 | Metz | 244/3.16 |
| 4,750,689 | A | * | 6/1988 | Yff | 244/3.14 |
| 4,951,901 | A | * | 8/1990 | Dunne | 244/3.11 |
| 5,099,246 | A | * | 3/1992 | Skagerlund | 244/3.14 |
| 5,146,616 | A | * | 9/1992 | Tang et al. | 244/3.19 |
| 5,163,637 | A | * | 11/1992 | Hansen | 244/3.14 |
| 5,238,204 | A | * | 8/1993 | Metz | 244/3.15 |
| 5,239,309 | A | * | 8/1993 | Tang et al. | 342/13 |
| 5,259,567 | A | * | 11/1993 | Jano et al. | 244/3.11 |

* cited by examiner

*Primary Examiner*—Charles T. Jordan
*Assistant Examiner*—Theresa M. Wesson
(74) *Attorney, Agent, or Firm*—David W. Collins; Andrew J. Rudd; Glenn H. Lenzen, Jr.

(57) ABSTRACT

An impulse radar guidance system and method for use with a spinning projectile. The system and method tracks the flight of the spinning projectile using an all-weather radar or tracker. A linearly polarized asymmetric waveform is transmitted at the projectile that comprises a series of repeating pulses having a relatively strong, short, positive electric field pulse followed by a relatively weak, long, negative electric-field baseline. The projectile contains a dipole antenna having a switching diode disposed between respective halves thereof. The waveform is reflected from the antenna which spins with the projectile and reflects a relatively strong signal when the electric field pulse of the asymmetric waveform is aligned along a conduction direction of the diode, a relatively weak reflected signal when the antenna and diode are aligned orthogonal to the electric field pulse, and a small, non-zero, signal when the diode is aligned anti-parallel to the electric field pulse and the diode is back-biased so that respective halves of the antenna are disconnected. The radar or tracker measures the instantaneous roll angle of the spinning projectile during its flight as a function of the state of the reflected signal. The projectile has a maneuvering device, and a receiver that receives commands that causes the maneuvering device to actuate at one or more specific roll-angles to deflect the flight direction of the projectile at a target.

12 Claims, 3 Drawing Sheets

IMPULSE RADAR GUIDANCE APPARATUS AND METHOD FOR USE WITH GUIDED PROJECTILES

BACKGROUND

The present invention relates generally to impulse radar guidance systems and methods, and more particularly, to an impulse radar guidance system and method for use with spinning guided projectiles.

Previous means to measure the roll angle of a projectile generally fall into one of three categories. The first is where the projectile is equipped with a roll gyroscope and a transmitter to communicate its roll angle to a launch control system. An example of this is an artillery round concept currently being developed by Bofors Weapons Systems of Sweden.

The second is where the projectile is provided with a polarizing reflector for use with either a radar or a laser. The polarization angle of received reflections indicates the roll angle. However, this method suffers from an ambiguity of 180° in roll. Thus, half the time, the projectile will be commanded to deflect in the wrong direction.

The third is where the projectile is imaged with a fast camera shortly after launch to detennine its roll angle. Polarized reflections are used to count and keep track of subsequent rolls. This is a very complicated method which fails if the data stream is interrupted during flight of the projectile.

Accordingly, it is an objective of the present invention to provide for an improved guidance apparatus and method for use with guided projectiles that overcomes the limitations of the approaches outlined above. It is a further objective of the present invention to provide for an impulse radar guidance apparatus and method for use with a spinning guided projectile has been disclosed that uses an asymmetric waveform to determine the instantaneous roll angle of the spinning projectile and resolves the 180° roll ambiguity of the projectile.

SUMMARY OF THE INVENTION

To meet the above and other objectives, the present invention provides for an improved impulse radar guidance system and method for use with spinning projectiles. The present invention provides for a method and apparatus for tracking the flight of a spinning projectile, bullet, missile, or artillery shell, for example, using an all-weather radar. By means of a novel impulse waveform and reflector on the spinning projectile, an impulse radar (tracker) measures the instantaneous roll angle of the spinning projectile during its flight. The projectile has a maneuvering. device, such as a side-firing thruster, and a receiver that is used as a data link to receive commands. Terminal maneuvering of the spinning projectile is accomplished by commanding the maneuvering device or thruster to fire at one or more specific roll-angles to deflect the flight direction of the projectile at a target.

The purpose of the present invention is to provide an all-weather long-range control system for spinning command-guided projectiles. Such projectiles can be very low cost, since they do not require seekers or complex on-board computers. Furthermore, a spinning projectile needs only a single deflection thruster to maneuver in any direction since the thruster can be fired at appropriate roll angles. In many applications, the thruster need be fired only once (a single-shot thruster) late in the flight in order to correct for initial launch errors.

The present invention thus provides a simple radar-means to measure the roll angle of the projectile at any time during its flight. The present invention may be used to provide an all-weather guided-bullet upgrade for the Phalanx gun system in the inventory of the U.S. Army.

The present invention provides for an improvement over the Bofors artillery-round concept outlined in the Background section. The present invention is simpler, lower in cost, and is believed to be more accurate. The present invention makes possible artillery rounds having much less dispersion in their impact patterns and thus makes them more effective than conventional systems.

The present invention makes possible, the development of very small guided-bullet systems which may be used for self defense against incoming missile threats. Applications range from defense of ground vehicles to aircraft self-defense.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
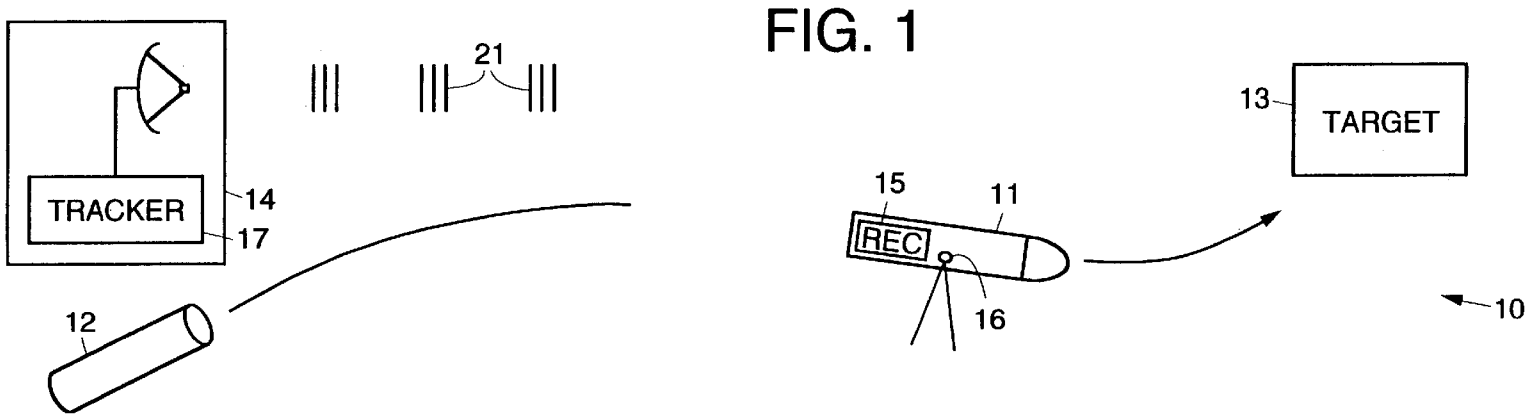
FIG. 1 illustrates an impulse radar guided projectile system and method for use with spinning guided projectiles in accordance with the principles of the present invention.

Referring to the drawing figures, FIG. 1 illustrates an impulse radar guided projectile system 10 and method 30 for use with a spinning guided projectile 11 in accordance with the principles of the present invention. FIG. 1 shows the spinning guided projectile 11, which may be a spinning bullet 11, missile, or artillery projectile 11, for example, that is launched from a launcher 12 at a target 13 and which may by guided to the target 13 using an impulse tracking radar 4 in accordance with the principles of the present invention. A guided projectile system 10 requires means for tracking the rotation of the spinning projectile 11 during its flight and a means for causing terminal maneuvering of the spinning projectile 11. Tracking is achieved by microwave or laser radar 14 that communicates with a receiver 15 (rec.) on the spinning projectile 11 that is used as part of a data link. Terminal maneuvering is provided by a side-firing thruster 16 on the spinning projectile 11. Terminal maneuvering of the spinning projectile 11 is accomplished by commanding the thruster 16 to fire at one or more specific roll-angles to deflect the flight direction of the spinning projectile 11 at the target 13.

Typically, a single thruster 16 is fired one or more times to deflect the spinning projectile 11. A tracker 17 on the launcher 12 or at the location of the radar 14 computes an appropriate fly-out range and direction to fire the thruster 16. Using the data link between the tracker 17 and the spinning projectile 11, the thruster 16 is commanded to fire when the spinning projectile 11 rotates to an appropriate roll angle.

A fundamental issue in controlling the firing of the thruster 16 is to determine the instantaneous roll angle of the spinning projectile 11. Various schemes employing the transmission or reflection of polarized radiation have been proposed and are outlined in the Background section. A fundamental problem with polarization approaches is an ambiguity in roll-angle sensing by 180°. For example, when the polarization axis is vertical, it is not possible to determine whether the thruster 16 is pointing directly up or directly down. In some cases, it is possible to image the spinning projectile 11 at a short range from the launcher 12 and then use polarization rotations to count the number of rotations during the remainder of the flight. Imaging approaches are complicated and not always practical.

To overcome the problems inherent in conventional approaches, the present invention provides a means for resolving the 180° roll ambiguity of the polarization. measurements of the spinning projectile 11. Use is made of a uniquely asymmetric waveform 21 that is generated by synthesizing ultra wideband short pulses from their individual spectral components. Such synthesized ultra wideband short pulses 22 may be generated using techniques disclosed in U.S. Pat. Nos. 5,146,616 and 5,239,309, for example, assigned to the assignee of the present invention.

Figure 2:
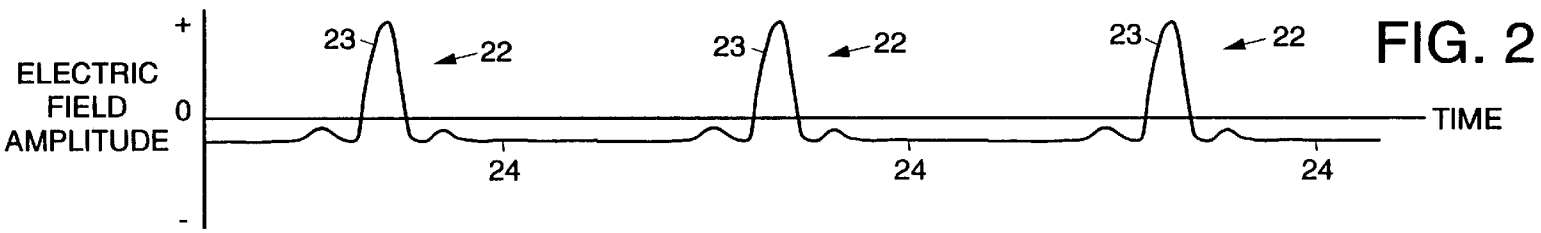
FIG. 2 illustrates an impulse radar waveform that is used in an impulse radar in accordance with the principles of the present invention.

Specifically, it has been found that resolution of the polarization ambiguity, and hence the true orientation of the spinning projectile 11, may be determined by radiating a series of repeating short pulses 22 having the electric field time-history shown in FIG. 2. This asymmetric waveform 21 has a relatively strong but short positive electric field pulse 23 followed by a relatively weak but long negative electric-field baseline 24. By radiating a plurality of pulses 22 having this time-history from a linearly polarized antenna 25 (FIG. 3) that is part of the radar 14, the electric field can be caused to point upward during the positive pulse and downward during the negative baseline.

Figure 3:
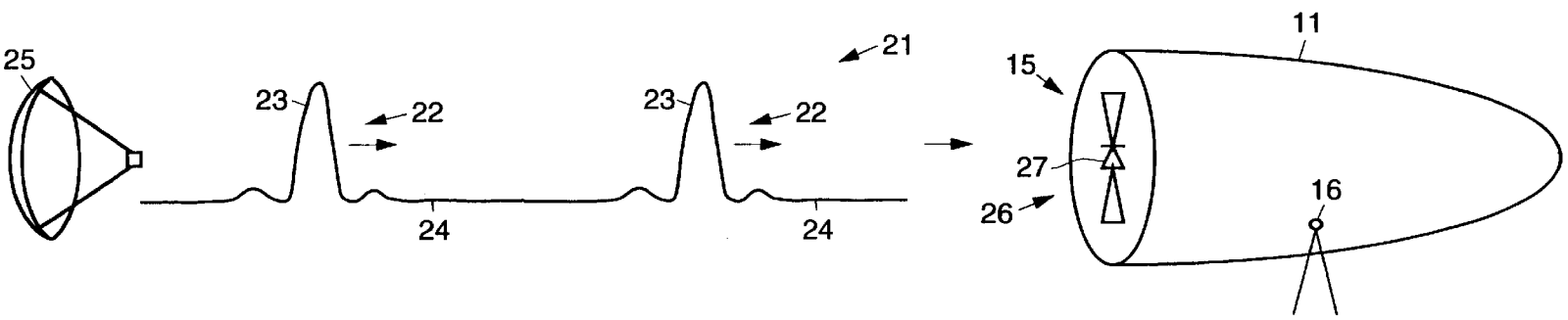
FIG. 3 shows a reflecting antenna employed on the guided projectile that is used to reflect the impulse radar waveform shown in FIG. 2 and which resolves ambiguities in the roll orientation of the spinning guided projectile.

To accurately control the guided projectile 11, it is provided with a reflecting dipole antenna 26 that contains a switching diode 27 as is shown in FIG. 3. The reflecting dipole antenna 26 and switching diode 27 rotate or spin with the projectile 11. More specifically, FIG. 3 shows the reflecting dipole antenna 26 employed on the spinning guided projectile 11 that is used to reflect the asymmetric impulse radar waveform 21 shown in FIG. 2. The reflected waveform 21 is processed to resolve ambiguities in the roll orientation of the spinning guided projectile 11.

When the electric field pulse 23 of the asymmetric waveform 21 shown in FIG. 3 are aligned along a conduction direction of the diode 27, the halves of the dipole antenna 26 are electrically connected. In this condition, the total reflected signal from the dipole antenna 26 is strong. When the antenna 26 and diode 27 are aligned orthogonal to the electric field pulse 23, the scattering strength is very small or weak and the total reflected signal is weak. When the diode 27 is aligned anti-parallel to the electric field pulse 23, the diode 27 is back-biased and the two halves of the antenna 26 are disconnected. In this back-biased condition, the scattering strength of the antenna 26 is small for the pulses 23 but non-zero.

By using the reflected signal strength generated by the antenna 26 and diode 27, the 180° roll ambiguity of the spinning projectile 11 is resolved. The radar 14, such as a microwave impulse radar, is used to track the roll angle of the spinning projectile 11 by monitoring the reflected signal, and in particular, the three states of the reflected signal; namely, strong, weak, and almost zero. This tracking may be performed in all weather conditions and at large line-of-sight distances.

Figure 4A:
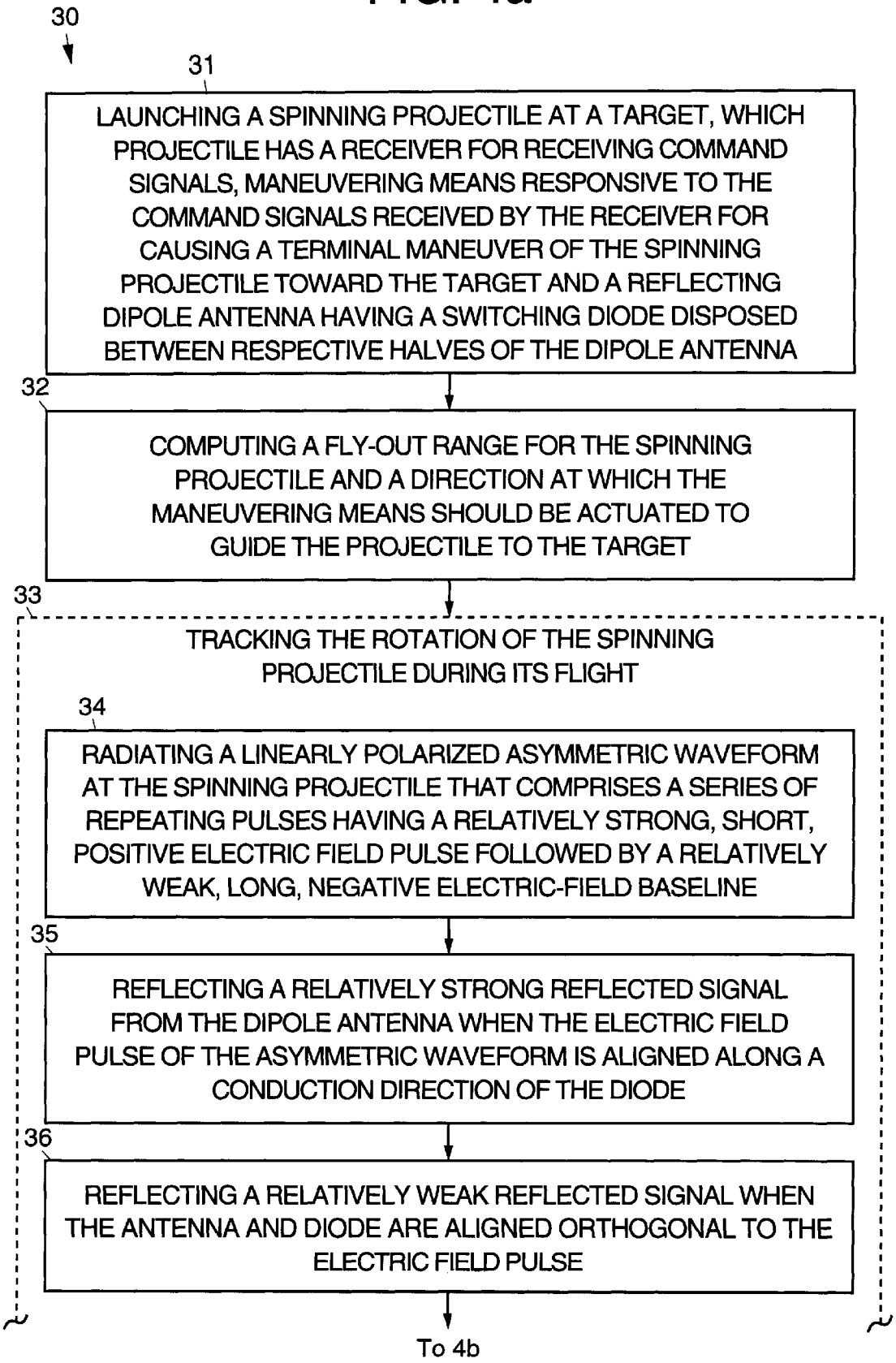
FIGS. 4*a* and 4*b* illustrate one method of guiding a spinning projectile at a target in accordance with the principles of the present invention.
Figure 4B:
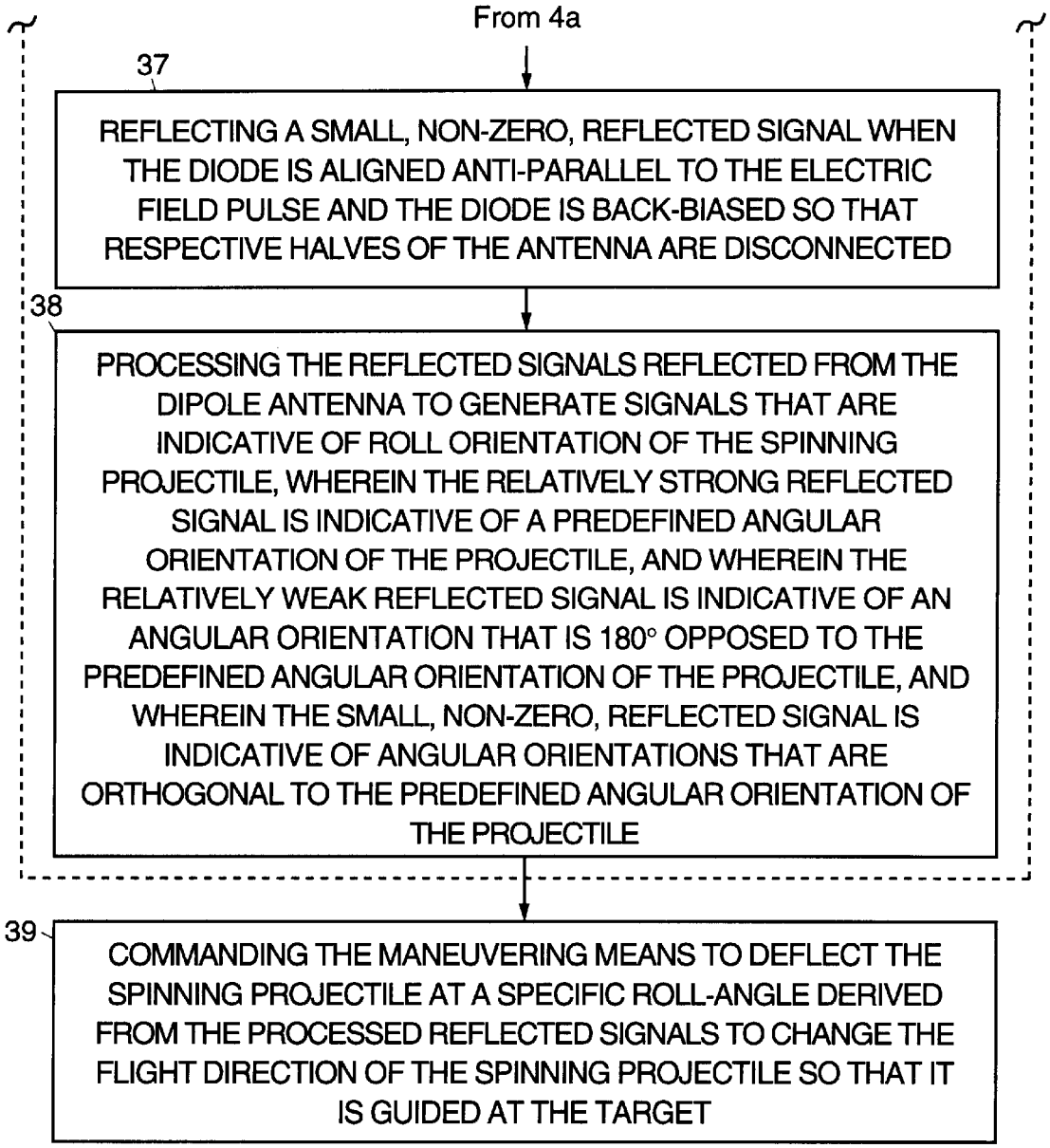

Referring to FIGS. 4*a* and 4*b* they illustrate one method 30 in accordance with the principles of the present invention of guiding a spinning guided projectile 11 at a target 13. The method 30 comprises the following steps. A spinning projectile 11 is launched 31 at the target 13. The projectile 11 comprises a receiver 15 for receiving command signals, maneuvering means 16 responsive to the command signals received by the receiver 15 for causing a terminal maneuver of the spinning projectile 11 toward the target 13, and a reflecting dipole antenna 26 that includes a switching diode 27 disposed between respective halves of the dipole antenna 26. A fly-out range for the spinning projectile 11 and a direction at which the maneuvering means 16 should be actuated to guide the projectile to the target 13 are computed 32.

The rotation of the spinning projectile 11 is tracked 33 during its flight by radiating 34 an linearly polarized asymmetric waveform 21 at the spinning projectile 11 that comprises a series of repeating pulses 22 having a relatively strong, short, positive electric field pulse 23 followed by a relatively weak, long, negative electric-field baseline 24. A relatively strong reflected signal is reflected 35 from the dipole antenna 26 when the electric field pulse 23 of the asymmetric waveform 21 is aligned along a conduction direction of the diode 27, and a relatively weak reflected signal is reflected 36 when the antenna 26 and diode 27 are aligned orthogonal to the electric field pulse 23, and a small, non-zero, reflected signal is reflected 37 when the diode 27 is aligned anti-parallel to the electric field pulse 23 and the diode 27 is back-biased so that respective halves of the antenna 26 are disconnected.

The reflected signals reflected from the dipole antenna 26 are processed 38 to generate signals that are indicative of roll orientation of the spinning projectile 11, wherein the relatively strong reflected signal is indicative of a predefined angular orientation of the projectile 11, and wherein the relatively weak reflected signal is indicative of an angular orientation that is 180° opposed to the predefined angular orientation of the projectile 11, and wherein the small, non-zero, reflected signal is indicative of angular orientations that are orthogonal to the predefined angular orientation of the projectile 11. The maneuvering means 16 is commanded 39 to deflect the spinning projectile 11 at a specific roll-angle derived from the processed reflected signals to change the flight direction of the spinning projectile 11 so that it is guided at the target 13.

Thus, an impulse radar guidance apparatus and method for use with a spinning guided projectile has been disclosed that uses an asymmetric waveform to determine the instantaneous roll angle of the spinning projectile and resolves the 180° roll ambiguity of the projectile. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An impulse radar guided projectile system for guiding a spinning proectile comprising:

a spinning projectile comprising a receiver for receiving commands, maneuvering means responsive to command signals received by the receiver for causing a terminal maneuver of the spinning projectile, and a reflecting dipole antenna having a switching diode disposed between respective halves of the dipole antenna;

a launcher for launching the spinning projectile at a target; and tracking means:

for computing a fly-out range for the spinning projectile and a direction at which the maneuvering means is actuated to guide the projectile to the target;

for tracking the rotation of the spinning projectile during projectile's flight by radiating a linearly polarized asymmetric waveform at the spinning projectile that comprises a series of repeating pulses having a relatively strong, short, positive electric field pulse followed by a relatively weak, long, negative electric-field baseline;

for processing signals reflected from the dipole antenna to generate signals that are indicative of roll orientation of the spinning projectile, which reflected signals are indicative of the roll orientation of the spinning projectile, whereby a relatively strong signal is reflected from the dipole antenna when the electric field pulse of the asymmetric waveform is aligned along a conduction direction of the diode, a relatively weak signal is reflected when the antenna and diode are aligned orthogonal to the electric field pulse, and a small, non-zero signal is reflected when the diode is aligned anti-parallel to the electric field pulse and the diode is back-biased so that respective halves of the antenna are disconnected; and for commanding the maneuvering means to deflect the spinning projectile at a specific roll-angle derived from the processed reflected signals to change the flight direction of the spinning projectile so that the spinning projectile is guided at the target.

2. The apparatus of claim 1 wherein the spinning projectile comprises a spinning bullet.

3. The apparatus of claim 1 wherein the spinning projectile comprises a spinning missile.

4. The apparatus of claim 3 wherein the spinning projectile comprises a spinning artillery projectile.

5. The apparatus of claim 1 wherein the tracking means comprises a microwave radar.

6. The apparatus of claim .1 wherein the tracking means comprises a laser radar.

7. The apparatus of claim 1 wherein the maneuvering means comprises a side-firing thruster.

8. The apparatus of claim 1 wherein the maneuvering means is commanded to fire when the spinning projectile rotates to a specified roll angle.

9. The apparatus of claim 1 wherein the asymmetric waveform is generated by synthesizing ultra wideband short pulses from their individual spectral components.

10. The apparatus of claim 1 wherein the tracking means comprises a linearly polarized antenna.

11. A method of guiding a spinning guided projectile at a target, said method comprising the steps of:

launchingia spinning projectile at the target, which projectile comprises a receiver for receiving command signals, maneuvering means responsive to the command signals received by the receiver for causing a terminal maneuver of the spinning projectile toward the target, and a reflecting dipole antenna having a switching diode disposed between respective halves of the dipole antenna;

computing a fly-out range for the spinning projectile and a direction at which the maneuvering means is actuated to guide the projectile to the target;

tracking the rotation of the spinning projectile during the projectile's flight by:

radiating a linearly polarized asymmetric waveform at the spinning projectile that comprises a series of repeating pulses having a relatively strong, short, positive electric field pulse followed by a relatively weak, long, negative electric-field baseline;

reflecting a relatively strong reflected signal from the dipole antenna when the electric field pulse of the asymmetric waveform is aligned along a conduction direction of the diode, reflecting a relatively weak reflected signal when the antenna and diode are aligned orthogonal to the electric field pulse, and reflecting a small, non-zero, reflected signal when the diode is aligned anti-parallel to the electric field pulse and the diode is back-biased so that respective halves of the antenna are disconnected;

processing the reflected signals reflected from the dipole antenna to generate signals that are indicative of roll orientation of the spinning projectile, wherein the relatively strong reflected signal is indicative of a predefined angular orientation of the projectile, wherein the relatively weak reflected signal is indicative of an angular orientation that is 180° opposed to the predefined angular orientation of the projectile, and wherein the small, nonzero, reflected signal is indicative of angular orientations that are orthogonal to the predefined angular orientation of the projectile; and commanding the maneuvering means to deflect the spinning projectile at a specific roll-angle derived from the processed reflected signals to change the flight direction of the spinning projectile so that the spinning projectile is guided at the target.

12. The method of claim 11 wherein the step of radiating a linearly polarized asymmetric waveform comprises the steps of:

synthesizing ultra wideband short pulses from individual spectral components to form an asymmetric waveform;

linearly polarizing the synthesized ultra wideband short pulses; and radiating the linearly polarized synthesized ultra wideband short pulses.

* * * * *